US007900409B2

(12) United States Patent
Kennelly

(10) Patent No.: US 7,900,409 B2
(45) Date of Patent: Mar. 8, 2011

(54) LINTEL CONFIGURATION

(75) Inventor: Bernard Joseph Kennelly, New South Wales (AU)

(73) Assignee: ITW Construction Systems Australia Pty Ltd, Victoria (AU)

( * ) Notice: Subject to any disclaimer, the term of this patent is extended or adjusted under 35 U.S.C. 154(b) by 158 days.

(21) Appl. No.: 12/049,411

(22) Filed: Mar. 17, 2008

(65) Prior Publication Data

US 2009/0183448 A1 Jul. 23, 2009

(30) Foreign Application Priority Data

Mar. 16, 2007 (AU) ..... 2007901384

(51) Int. Cl.
*E04C 3/02* (2006.01)

(52) U.S. Cl. ..... 52/204.2; 52/656.4

(58) Field of Classification Search ..... 52/204.2, 52/210, 211, 656.2, 656.4, 656.5, 656.9, 52/842, 846, 715, 696
See application file for complete search history.

(56) References Cited

U.S. PATENT DOCUMENTS 2,103,064 A * 12/1937 Clark ..... 52/696
3,222,836 A * 12/1965 Collin et al. ..... 52/281
4,096,670 A * 6/1978 Fuller ..... 52/92.2
4,424,652 A * 1/1984 Turner ..... 52/204.2
5,551,200 A * 9/1996 Krug ..... 52/696
5,572,834 A * 11/1996 Lilly ..... 52/85
6,047,503 A * 4/2000 Kost ..... 52/79.9
6,260,318 B1 * 7/2001 Herren ..... 52/317
6,389,762 B2 * 5/2002 Le Poire ..... 52/204.2
6,494,012 B2 * 12/2002 Seng ..... 52/841
2004/0144057 A1 * 7/2004 Meek et al. ..... 52/656.2

FOREIGN PATENT DOCUMENTS

GB 2032502 * 5/1980

* cited by examiner

*Primary Examiner* — Robert J Canfield
*Assistant Examiner* — Christine T Cajilig
(74) *Attorney, Agent, or Firm* — Lowe, Hauptman, Ham & Berner, LLP (ITW)

(57) ABSTRACT

A timber wall frame for use in building construction has an opening for a door or window defined at each side by a vertically extending prop stud and jamb stud in side by side relation, and the opening is defined from above by a horizontally extending top plate of the wall frame. The prop stud and jamb stud are of the same length and extend to the underside of the top plate. A lintel of sheet metal spans the upper side of the opening, the lintel having a vertical wall and a horizontal flange along the upper edge of the wall. The lintel is applied to the frame so that its vertical wall overlies a face of each stud and a face of the top plate, with the horizontal flange of the lintel being above the top plate.

7 Claims, 5 Drawing Sheets

LINTEL CONFIGURATION

RELATED APPLICATIONS

The present application is based on, and claims priority from, Australian Application Number 2007901384, filed Mar. 16, 2007, the disclosure of which is hereby incorporated by reference herein in its entirety.

BACKGROUND OF THE INVENTION

1. Field of the Invention

The present invention relates to a lintel configuration within a wall frame for use in building construction.

2. Description of the Prior Art

Wall frames for building construction, particularly for domestic buildings, are commonly prefabricated in a factory and then transported to site for speedy erection. A prefabricated wall frame will usually consist of one or more window, door or other openings to receive a prefabricated window or door frame which is installed or finished on site. Each such opening is spanned along its upper edge by a lintel to carry the loading applied to the top plate of the wall frame by trusses or other building components above the lintel. FIG. 1 shows a typical lintel configuration within a prefabricated wall frame. The portion of the frame shown in that Figure has a vertical jamb stud 2, a vertical prop stud 4 immediately adjacent the jamb stud, a horizontal top plate 6, and an additional horizontal top plate 8 above that. The lintel 10 spanning the door or window opening extends across the underside of the top plate 6 and is supported at its lower edge by the prop stud 4. The lintel in this case is formed by a wooden beam but it may alternatively be formed by a metal beam such as a light steel beam of channel cross-section. It will be noted that the prop stud 4 needs to be cut to a shorter length than the jamb stud 2 in order to support the underside of the lintel 10 and this is inconvenient in a factory situation involving the assembly of multiple frames where it is desirable to standardise to the maximum extent possible the pre-cut components needed to assembly the various frames.

In this case the prop stud 4 provides the majority of the support for the lintel with some load being transferred to the jamb stud 2 by virtue of the connections (usually nails) between the two. However, the jamb stud 2 mainly serves to provide continuity between the prop stud 4 and the top plate and has minor load bearing capacity. Since the prop stud 4 resists higher loads than the jamb stud 2 or the common studs in the wall frame, apart from being a different length it may need to be of a higher grade which is an added complication in the manufacturing process as it is then necessary to access a different grade of timber and to ensure that it is installed in that particular location in the frame. The increase in grade of the prop stud 4 may not always be sufficient to withstand the magnitude of the applied load and the prop stud 4 may have to be doubled or tripled. Without significant fixing between the prop stud 4 and the jamb stud 2 it is not possible to take advantage of the unused strength of the jamb stud 2.

Moreover, as would be understood, the stiffness of a lintel in the direction of the applied load (a vertical loading) is determined to a significant extent by its depth and with the configuration illustrated in FIG. 1 its depth is inherently limited by the height of the opening it is spanning and by the overall height of the wall frame and as a result, for increased stiffness to resist deflection, a substantial increase is needed in the thickness or bulk of the beam or in the grade or type. While an increase in the depth of the lintel could be achieved by removal of the top plate in the zone of the lintel, this leads to reduced lateral stability of the frame and also leads to other difficulties in the overall construction of the frame and is not a particularly desirable approach to achieving required lintel strength.

SUMMARY OF THE INVENTION

According to the present invention there is provided a timber wall frame for use in building construction, the wall frame having at least one window and/or door opening defined by a stud at each side of the opening and a lintel spanning the upper side of the opening, wherein the lintel is of sheet metal, the lintel having a vertical wall and a horizontal flange along an upper edge of the vertical wall, and wherein the lintel is applied to the frame so that its vertical wall overlies a face of each stud and a face of a first top plate of the wall frame, with the flange of the lintel being above the top plate.

In the preferred embodiment of the invention, the wall frame has an additional top plate supported by the first top plate, and the opening is defined at each side by a prop stud which is immediately adjacent to a jamb stud, the prop studs and jamb studs extending to the underside of the first top plate. The vertical wall of the lintel extends across the faces of the prop studs and jamb studs and is secured thereto preferably by screwing through the vertical wall of the lintel.

In one embodiment, the sheet metal lintel is in the form of a beam having upper and lower flanges of double thickness construction with a hollow interior, the upper flange resting on the upper side of the first top plate with the upper side of the flange being approximately level with the upper side of the additional top plate omitted in the zone of the lintel. In another embodiment, the sheet metal lintel is of single thickness construction and its upper flange rests against, and is secured to, the upper side of the top plate or the additional top plate.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 2:
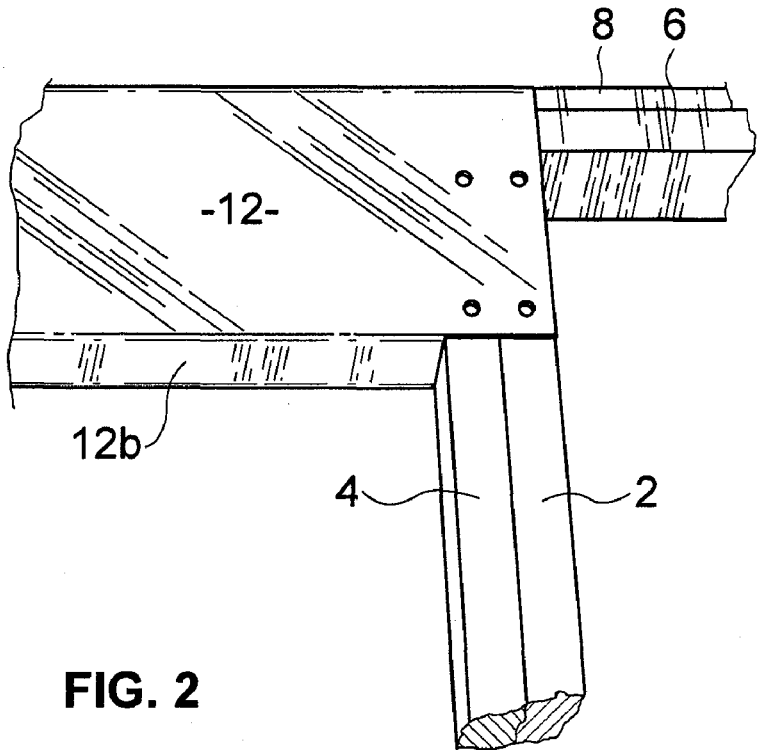
FIG. 2 is a view from the front of a portion of a wall frame having a lintel configuration in accordance with the invention.
Figure 3:
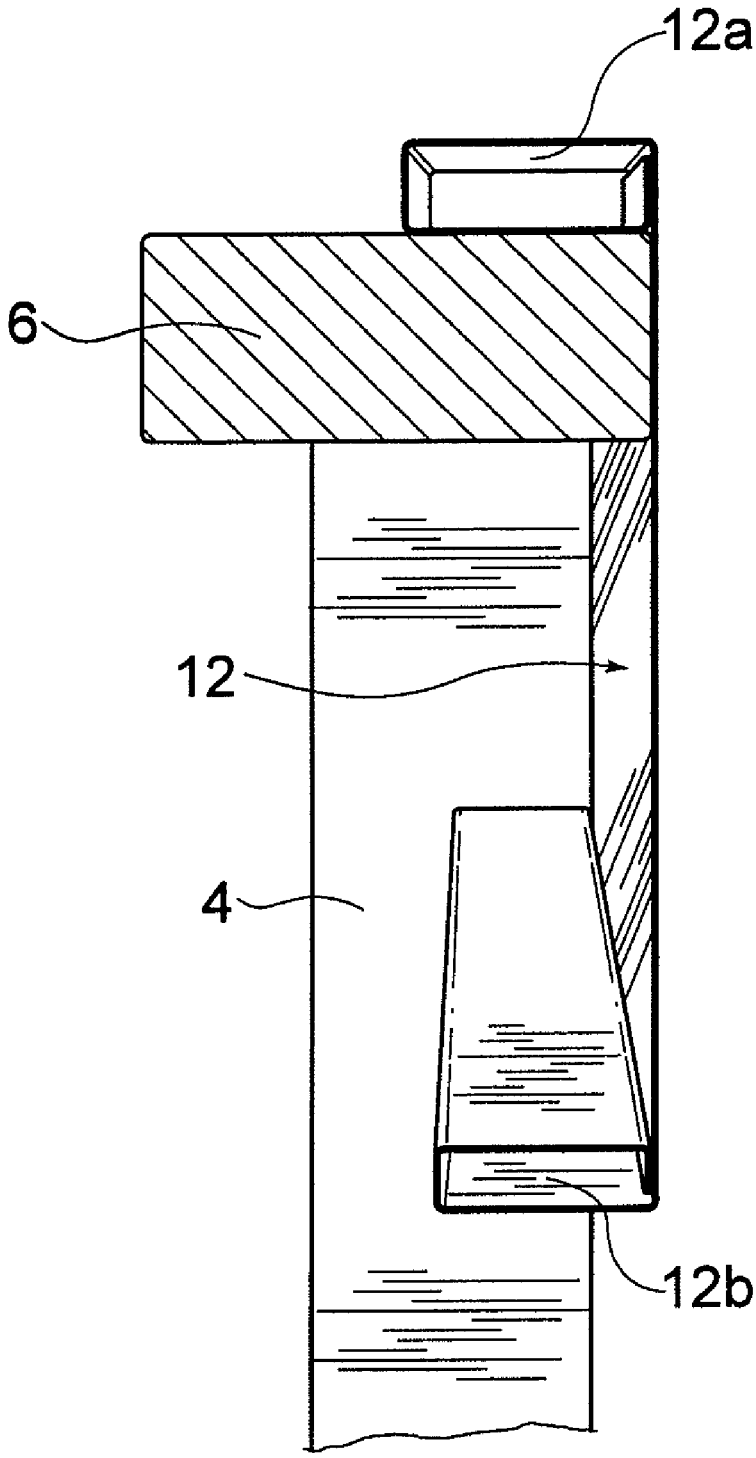
FIG. 3 is a sectional end view equivalent to FIG. 2.

With reference to FIGS. 2 and 3, the lintel 12 is formed by a so-called light steel beam which is a beam of channel section formed from rolled steel strip with rolled flanges of hollow section completed by welding the steel strip during rolling into the required shape, the two flanges thereby effectively being of double thickness construction. The lintel 12 is applied so that its upper flange 12*a* overlies the top plate 6 of the frame and is fixed to the top plate typically by screwing. The additional top plate 8 is omitted in the zone of the lintel and the upper side of the lintel is approximately level with the upper side of the additional top plate at either end of the lintel. With this configuration the prop stud 4 extends to the underside of the top plate 6 and is therefore of the same length as the jamb stud 2 so that studs of appropriate length can be cut for use either as prop studs or jamb studs. The lower flange 12*b* of the lintel is cut back as shown in FIG. 2 (with a corresponding cut back being made at the other end of the lintel) so that the lower flange 12*b* will fit between the opposed prop studs 4 defining the opening. The vertical wall of the lintel 12 is secured at each end to the adjacent jamb stud and prop stud typically by screwing.

The ability to use prop studs and jamb studs of the same length is of significant benefit in a factory situation where many wall frames of the same height are being fabricated. In particular, to enhance productivity and reduce the skill levels required, multiples of common studs can be used to form the prop stud and jamb stud combination. Moreover, the lintel is easily and quickly applied to the frame by laying it over the top plate and the studs and screwing to the frame and this is a more straightforward process than that involved in mounting the lintel in the configuration of FIG. 1 as the configuration ensures that the lintel will lie flat against the face of the frame. It will also be noted that for a given height of wall frame and height of the opening spanned by the lintel, the depth of the lintel can be maximised as the upper surface of its upper flange is approximately level with the uppermost extent of the wall frame thus making optimum use of the available depth of the lintel.

The presence of the upper flange of the lintel on the top plate replaces the additional top plate in the zone of the lintel. In many cases a significant part of the length of a wall frame can be taken by window and door openings and the omission of the additional top plate in the zone of the lintels results in cost savings.

Figure 4:
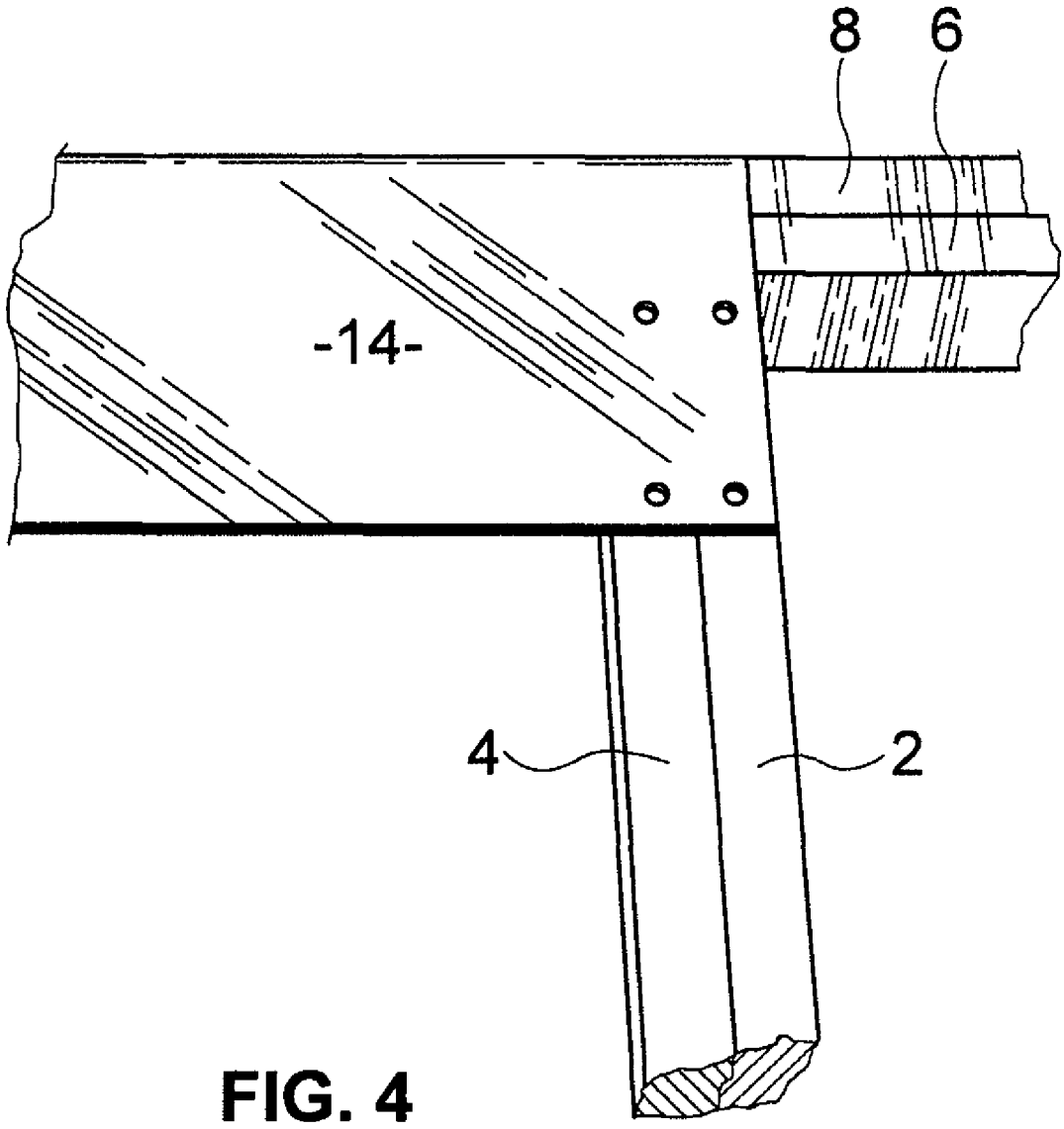
FIG. 4 is a view similar to FIG. 2 but showing an alternative lintel configuration in accordance with the invention.
Figure 5:
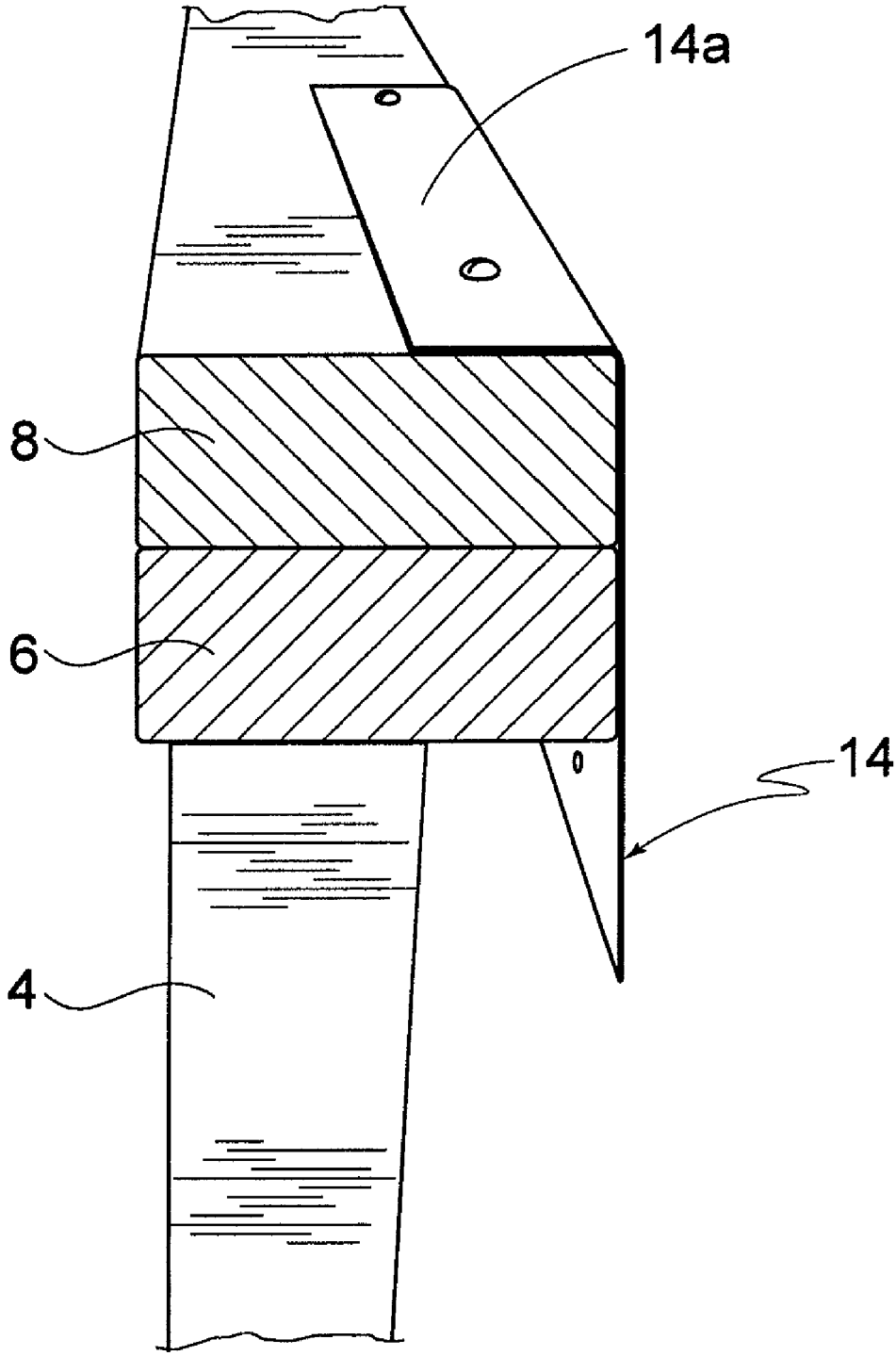
FIG. 5 is a sectional end view equivalent to FIG. 4.

In the embodiment shown in FIGS. 4 and 5, the lintel 14 is a rolled steel lintel of L-section whereby its flange 14*a* is just of single thickness construction in contrast to the construction of the flanges of the lintel 12. The lintel 14 is applied over the frame with its flange 14*a* lying against the upper side of the additional top plate 8 and secured to the additional top plate 8 typically by screwing. The vertical wall of the lintel 14 is secured at each end to the jamb stud 2 and prop stud 4 by screwing. As with the embodiment of FIGS. 2 and 3, the prop stud 4 and jamb stud 2 are of the same length and the application of the flange of the lintel over the top plate, in this case the additional top plate 8, enables the depth of the lintel to be maximised. Alternatively it could be applied with the upper flange lying against the upper side of the top plate 6.

In a modification, the lintel 14 has a second flange along its lower edge and in that case the lower flange will be cut back at each end to lie adjacent the inside face of the prop stud in a similar manner to that shown in FIG. 2. The lintel with the lower flange will have greater bending resistance and hence an increase in uplift capacity to the L-sectioned lintel shown in FIGS. 4 and 5.

Figure 1:
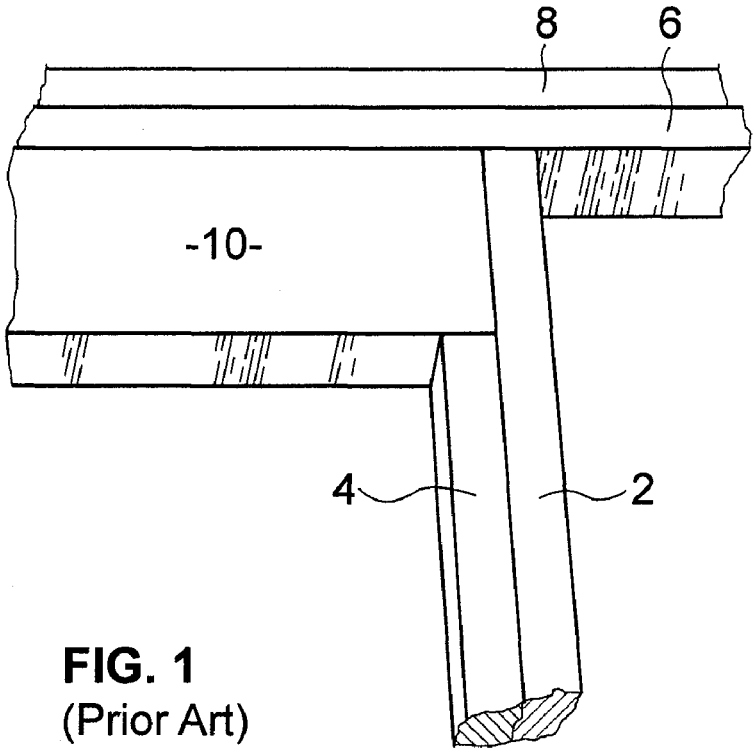
FIG. 1 (Prior Art)
FIG. 1 depicts a lintel configuration within a prefabricated wall frame according to a known embodiment.

Whereas the prior lintel configuration described with reference to FIG. 1 requires the lintel to be cut to a very precise length to ensure it is a tight fit between the jamb studs to permit securing by nailing through the jamb studs into the lintel, the precise fit does not need to occur with the lintel configurations of the preferred embodiments described with reference to FIGS. 2 to 5. With the configuration of FIGS. 4 and 5 absent the lower flange, variation in longitudinal placement and overall length can be tolerated. For the configuration shown in FIGS. 2 and 3 and a configuration similar to that of FIGS. 4 and 5 but with a lower flange, the cut back into the lower flange to enable it to locate between the prop studs does not have to be undertaken with sufficient accuracy to provide a tight fit.

Figure 6A:
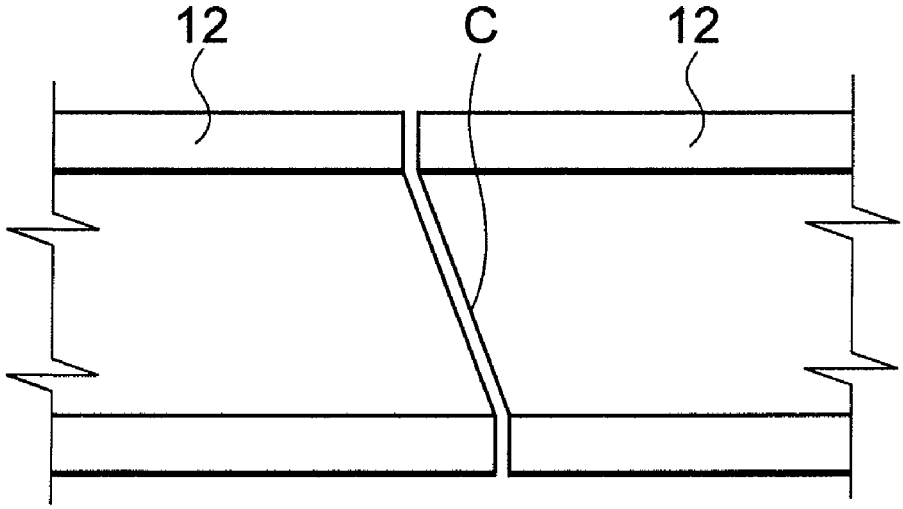
FIGS. 6A and 6B are views showing preferred forms of end cut for the lintel.
Figure 6B:
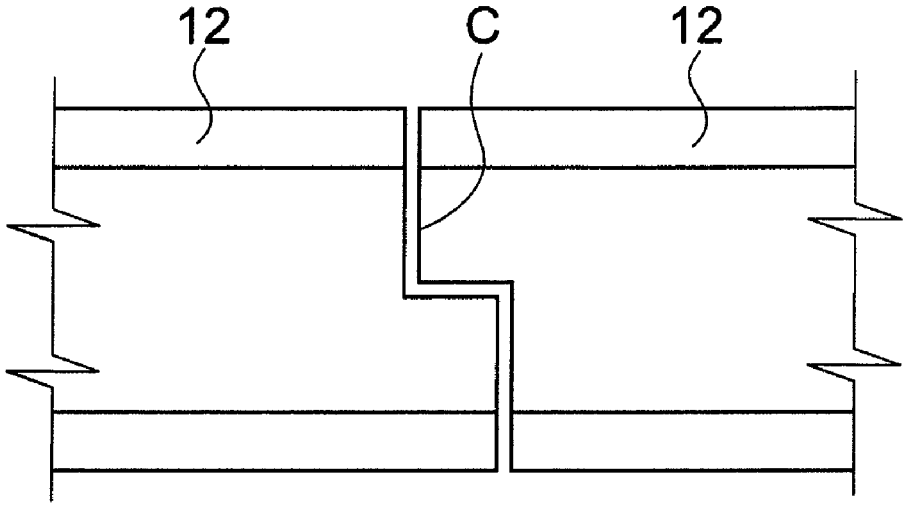

With the configurations discussed above which require the lower flange to be cut back to locate between the prop studs, it is preferred to cut the ends of the lintel so that the vertical cuts through the upper and lower flanges are offset laterally by a distance corresponding to the combined width of the prop and jamb studs; examples of such a cut are illustrated in FIGS. 6A and 6B for the lintel 12. In this regard, the lintels will typically be cut to the required length from a longer length of stock material. An end cut such as those represented by C in FIGS. 6A and 6B will provide the lower flange cut back in two adjacent lengths of lintel without wastage of material as the general symmetry of the cut will produce the same cut back in the two adjacent lintels when installed and which will require inversion of the left hand lintel from the orientation shown.

The embodiments have been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. A timber wall frame for use in building construction, the wall frame comprising:

a top plate having a first surface and a second surface opposite to the first surface;

first and second studs directly contacting each other and extending to the second surface of the top plate; and a lintel formed of a sheet metal and extending along the first and second studs and beyond the top plate, wherein the lintel includes a vertical wall extending in a vertical direction, having an upper edge and a lower edge opposite to the upper edge, and overlying a combined width of the first and second studs;

a first flange horizontally extending along the upper edge of the vertical wall and overlying the top plate, and a second flange horizontally extending along the lower edge of the vertical wall over a length shorter than the first flange.

2. The wall frame according to claim 1, further comprising an additional top plate directly disposed on the first surface of the top plate, wherein said first stud is a prop stud and said second stud is a jamb stud directly contacting the prop stud, the top plate supports the additional top plate from below, and the first flange overlies the top plate and the additional top plate.

3. A timber wall frame for use in building construction, the wall frame comprising:

a top plate;

first and second studs directly contacting each other and extending to the top plate; and a lintel extending along the first and second studs and beyond the top plate, wherein the lintel is of sheet metal, and includes a vertical wall and upper and lower horizontal flanges along an upper edge and a lower edge of the vertical wall, respectively, wherein the vertical wall overlies a face of each of the first and second studs and a face of the top plate, with the flange of the lintel being above the top plate, wherein the wall frame further comprises an additional top plate directly supported by the top plate, wherein the sheet metal lintel is in the form of a beam and further includes said upper and lower flanges of double thickness construction with a hollow interior, the upper flange resting on an upper side of the top plate with an upper side of the upper flange being approximately level with an upper side of the additional top plate omitted in the zone of the lintel, and wherein the lower flange is cut back relative to the upper flange.

4. A timber wall frame for use in building construction, the wall frame comprising:

a top plate having a first surface and a second surface opposite to the first surface;

first and second studs directly contacting each other and extending to the second surface of the top plate; and a lintel formed of a sheet metal and extending along the first and second studs and beyond the top plate, an additional top plate directly disposed on the first surface of the top plate, wherein the lintel includes a vertical wall extending in a vertical direction, having an upper edge and a lower edge opposite to the upper edge, and overlying a combined width of the first and second studs;

a horizontal upper flange horizontally extending along an upper edge of the vertical wall the upper edge of the vertical wall and overlying the top plate, wherein said first stud is a prop stud and said second stud is a jamb stud directly contacting the prop stud, the top plate supports the additional top plate from below, the horizontal flange overlies the top plate and the additional top plate, and the lintel has a lower flange cut back relative to the upper flange.

5. The wall frame according to claim 3, wherein the lower flange is cut back relative to the upper flange by a distance corresponding to the combined width of the first and second studs.

6. The wall frame according to claim 4, wherein the lower flange is cut back relative to the upper flange by a distance corresponding to the combined width of the prop and jamb studs.

7. A timber wall frame for use in building construction, the wall frame comprising:

a prop stud extending in a first direction;

a jamb stud adjacent to the prop stud in a second direction perpendicular to the first direction, said prop stud and said jamb stud in a side-by-side relation defining a lateral side of an opening for a door or window;

a top plate extending in the second direction and formed above the prop stud and the jamb stud for defining an upper side of the opening; and a lintel formed of a sheet metal and spanning the upper side of the opening, wherein the prop stud and the jamb stud both extend to the top plate, and wherein the lintel has a wall extending in the first direction and overlying the prop stud, the jamb stud and the top plate;

a first flange extending along an upper edge of the wall in the second direction, and being above the top plate; and a second flange extending along a lower edge of the wall in the second direction and having an end that lies adjacent to a lateral surface of the prop stud.

* * * * *